United States Patent [19]

Matsushita et al.

[11] 3,983,279

[45] Sept. 28, 1976

[54] MULTIPLE HEAT-SENSITIVE COPYING MEDIUM

[75] Inventors: Hiromu Matsushita, Habikino; Takashi Yamahata, Koriyama; Hiroshi Kakimoto, Kyoto, all of Japan

[73] Assignee: General Company, Ltd., Osaka, Japan

[22] Filed: July 15, 1974

[21] Appl. No.: 488,456

[52] U.S. Cl. ..... 428/101; 428/486

[51] Int. Cl.[2] ..... B41M 5/10

[58] Field of Search ..... 117/3.2, 3.4, 36.1, 117/36.2, 68; 427/148, 56; 428/101, 486

[56] References Cited

UNITED STATES PATENTS

| | | | |
|---|---|---|---|
| 2,168,098 | 8/1939 | Groak | 117/36.2 |
| 2,348,128 | 5/1944 | Groak | 117/36.2 |
| 2,870,040 | 1/1959 | Gill | 117/36.2 |
| 3,244,549 | 4/1966 | Farnham et al. | 117/36.2 |
| 3,640,750 | 2/1972 | Schutzner | 117/36.2 |
| 3,788,875 | 1/1974 | Schutzner | 117/1.7 |
| 3,859,094 | 1/1975 | Franer et al. | 117/3.2 |

*Primary Examiner*—Bernard D. Pianalto

*Attorney, Agent, or Firm*—Fitzpatrick, Cella, Harper & Scinto

[57] ABSTRACT

A multiple heat-sensitive copying medium comprises a double-sided heat-sensitive member having a heat-sensitive color forming layer, a good thermally conductive substrate and a heat-sensitive transferring layer containing a heat-sensitive color forming material.

8 Claims, 8 Drawing Figures

MULTIPLE HEAT-SENSITIVE COPYING MEDIUM

BACKGROUND OF THE INVENTION

1. Field of the Invention

This invention relates to a multiple heat-sensitive copying medium, and more particularly to a multiple heat-sensitive copying medium adapted for use in the heat-sensitive recording system.

2. Description of the Prior Art

A nonimpact system has been recently developed in the field of recording in the data communication such as a facsimile, an output of a computer and the like. The most important advantage of the nonimpact system resides in that a noise annoying operators can be eliminated to a great extent and this nonimpact system is characterized by "a gentle print recording system". A heat-sensitive recording sheet is also used as one of the media in the nonimpact system. However, a practical disadvantage of the heat-sensitive recording sheet as well as the nonimpact system is that simultaneous copying is extremely difficult, and more particularly that the same plural records can be hardly obtained simultaneously by using one recording element, which is a heat element in a heat-sensitive recording system. As for such a heat-sensitive recording sheet as takes a printing time of only about 10 milliseconds, if two conventional heat-sensitive sheets are put one upon the other and printed by applying a thermal printer to the top one of the two heat-sensitive recording sheets, it would be so difficult to color-develop the bottom recording sheet that the same two records can not be obtained simultaneously.

SUMMARY OF THE INVENTION

It is an object of this invention to provide a multiple heat-sensitive copying medium which can produce one or more copies simultaneously by using one recording element for a heat-sensitive recording system in the field of recording.

According to the first aspect of this invention, there is provided a multiple heat-sensitive copying medium comprising a double-sided heat-sensitive member having on one side of the substrate thereof a heat-sensitive color forming layer and on the other side of the substrate thereof a heat-sensitive transferring layer, said substrate being of a good thermal conductivity and said heat-sensitive transferring layer containing a heat-sensitive color forming material.

According to the second aspect of this invention, there is provided a multiple heat-sensitive copying medium comprising a double-sided heat-sensitive member having on one side of the good thermally conductive substrate thereof a heat-sensitive color forming layer and on the other side of the substrate thereof a heat-sensitive transferring layer containing a heat-sensitive color forming material, and at least one intermediate member having a good thermally conductive substrate and a heat-sensitive transferring layer containing a heat-sensitive color forming material, said intermediate member being disposed so that the opposite side to the heat-sensitive transferring layer thereof and the heat-sensitive transferring layer of said double-sided heat-sensitive member may be maintained in face to face relationship.

According to the third aspect of this invention, there is provided a multiple heat-sensitive copying medium comprising a double-sided heat-sensitive member having on one side of the good thermally conductive substrate thereof a heat-sensitive color forming layer and on the other side of the substrate thereof a heat-sensitive transferring layer containing a heat-sensitive color forming material, and a transferred image-receiving member having on one side a transferred image-receiving agent layer, said transferred image-receiving member being disposed so that the transferred image-receiving agent layer thereof and the heat-sensitive transferring layer of said double-sided heat-sensitive member are maintained in fact to face relationship.

According to the fourth aspect of this invention, there is provided a multiple heat-sensitive copying medium comprising a double-sided heat-sensitive member having on one side of the good thermally conductive substrate thereof a heat-sensitive color forming layer and on the other side of the substrate thereof a heat-sentsitive transferring layer containing a heat-sensitive color forming material, at least one intermediate member having on one side of the good thermally conductive substrate thereof a transferred image-receiving agent layer and on the other side of the substrate thereof a heat-sensitive transferring layer containing a heat-sensitive color forming material and a transferred image-receiving member having on one side a transferred image-receiving agent layer, said intermediate member being disposed between said double-sided heat-sensitive member and said transferred image-receiving member so that said transferred image-receiving agent layer of said intermediate member and said heat-sensitive transferring layer of said double-sided heat-sensitive member, and said heat-sensitive transferring layer of said intermediate member and said transferred image-receiving agent layer of said transferred image-receiving member are maintained in fact to face relationship, respectively.

DESCRIPTION OF THE PREFERRED EMBODIMENTS

The preferred embodiments of this invention are explained in detail below with reference to the attached drawings.

Figure 1:
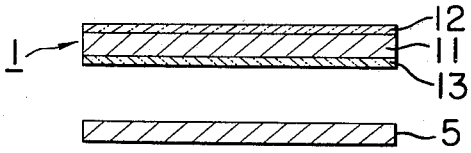
FIG. 1 shows schematically an enlarged cross-sectional view of a multiple heat-sensitive copying medium according to the first aspect of this invention and a transferred image-receiving member which are combined with each other.

FIG. 1 shows a multiple heat-sensitive copying medium according to the first aspect of this invention comprising a double-sided heat-sensitive member 1, and a transferred image-receiving member 5 which serves as a receiver of an image to be transferred from the double-sided heat-sensitive member 1. The transferred image-receiving member 5 does not need any particular treatment and, for example, a usual paper, a thin film-like material, any material having a surface capable of receiving the transferred image and the like can be used as the transferred image-receiving member 5 without any strict restriction. The double-sided heat-sensitive member 1 has a heat-sensitive color forming layer 12 provided on one side of a good thermally conductive substrate 11 thereof and a heat-sensitive transferring layer 13 containing a heat sensitive color forming material on the other side of the substrate 11.

Figure 3:
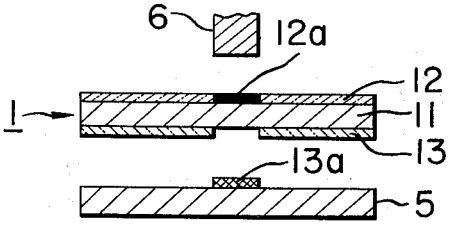
FIG. 3 shows schematically an enlarged cross-sectional view of the state in which a printed image is obtained in the combination of FIG. 1.

FIG. 3 illustrates the state in which the copying is carried out by using the double-sided heat-sensitive member 1 as shown in FIG. 1. A heat element 6 which serves as a recorder of an image is applied to the upper surface of the double-sided heat-sensitive member 1 to produce a colored image 12*a* on the heat-sensitive color forming layer 12. The portion of the heat-sensitive transferring layer 13 containing a heat-sensitive color forming material which corresponds to the colored image is color-developed and transferred to the upper surface of the transferred image-receiving member 5 to produce a transferred image 13*a*.

In the drawing, the double-sided heat-sensitive member 1 and the transferred image-receiving member 5 are illustrated in such a way that they are placed at a certain distance, to facilitate the understanding of the copying state. However, it is usual that the both members are in contact with each other in the practical operation.

Figure 2:
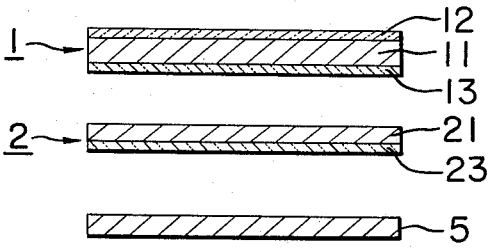
FIG. 2 shows schematically an enlarged cross-sectional view of a multiple heat-sensitive copying medium according to the second aspect of this invention and a transferred image-receiving member which are combined with each other.

FIG. 2 shows an example of a multiple heat-sensitive copying medium according to the second aspect of this invention. The multiple heat-sensitive copying medium comprises a double-sided heat-sensitive member 1 similar to that shown in FIG. 1 and an intermediate member 2 having a good thermally conductive substrate 21 and a heat-sensitive transferring layer 23 containing a heat-sensitive color forming material which is laminated on the bottom surface of the substrate 21. A transferred image-receiving member 5 similar to that shown in FIG. 1 is placed beneath the intermediate member 2. In the drawing, reference numerals 11, 12 and 13 denote the same parts as those in FIG. 1.

Figure 4:
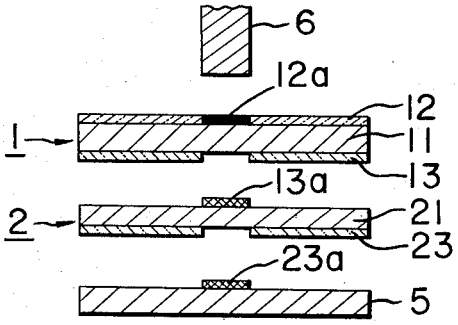
FIG. 4 shows schematically an enlarged cross-sectional view of the state in which printed images are obtained in the combination of FIG. 2.

FIG. 4 illustrates the state in which the copying is carried out by using a multiple heat-sensitive copying medium as shown in FIG. 2 comprising the double-sided heat-sensitive member 1, the intermediate member 2, and the transferred image-receiving member 5. When practically operated, the double-sided heat-sensitive member 1, the intermediate member 2 and the transferred image-receiving member 5 are usually placed so as to bring them into contact with one another.

The heat element for recording an image is applied to the heat-sensitive color forming layer 12 of the double-sided heat sensitive member 1 to produce a colored image 12*a*. The corresponding portion of the underlying heat-sensitive transferring layer 13 containing a heat-sensitive color forming material and the corresponding portion of the heat-sensitive transferring layer 23 of the intermediate member 2 are each color-developed and transferred onto the substrate 21 of the intermediate member 2 and the transferred image-receiving member 5, respectively to produce transferred images 13*a* and 23*a*.

Figure 5:
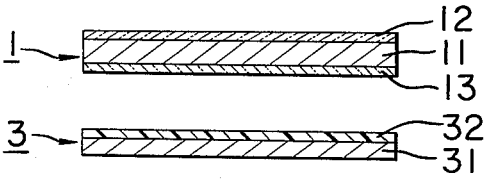
FIG. 5 shows schematically an enlarged cross-sectional view of a multiple heat-sensitive copying medium according to the third aspect of this invention.

FIG. 5 shows an example of a multiple heat-sensitive copying medium according to the third aspect of this invention which comprises a double-sided heat-sensitive member 1 similar to that shown in FIG. 1 and a transferred image-receiving member 3 having a substrate 31 and a transferred image-receiving agent layer 32 provided on the upper surface of the substrate 31. In the drawing, reference numerals 11, 12 and 13 denote the same parts as those in FIG. 1.

Figure 7:
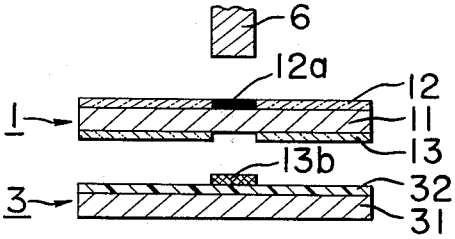
FIG. 7 shows schematically an enlarged cross-sectional view of the state in which a printed image is obtained in the combination of FIG. 5.

FIG. 7 illustrates the state in which the copying is carried out by using the multiple heat-sensitive copying medium as shown in FIG. 5. The heat element 6 for recording an image is applied to the heat-sensitive color forming layer 12 of the double-sided heat-sensitive member 1 to produce a colored image 12*a*. The corresponding portion of the underlying heat-sensitive transferring layer 13 containing a heat-sensitive color forming material is color-developed and transferred onto the transferred image-receiving agent layer 32 of the transferred image-receiving member 3 to produce a transferred image 13*b*.

Figure 6:
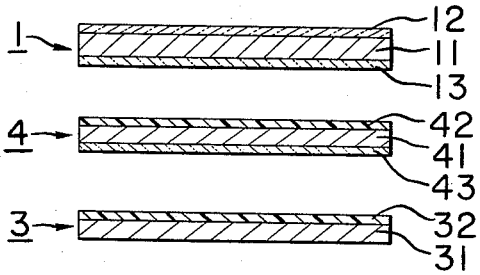
FIG. 6 shows schematically an enlarged cross-sectional view of a multiple heat-sensitive copying medium according to the fourth aspect of this invention.

FIG. 6 shows an example of the multiple heat-sensitive copying medium according to the fourth aspect of this invention which comprises a double-sided heat-sensitive member 1 similar to that shown in FIG. 1, a transferred image-receiving member 3 similar to that in FIG. 5 and an intermediate member 4 having a transferred image-receiving agent layer 42 provided on the upper surface of a good thermally conductive substrate 41 thereof and a heat-sensitive transferring layer 43 containing a heat-sensitive color forming material on the bottom surface of the substrate 41. In addition, the intermediate member 4 is placed between the double-sided heat-sensitive member 1 and the transferred image-receiving member 3. In the drawing, reference numerals 11, 12 and 13 denote the same parts as those in FIG. 1.

Figure 8:
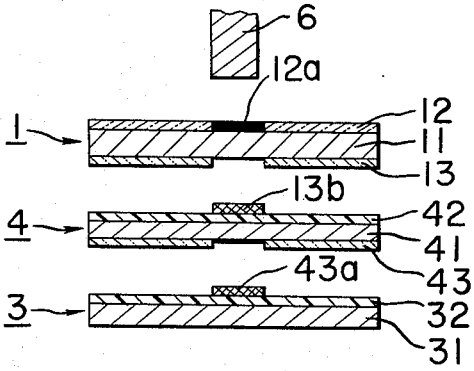
FIG. 8 shows schematically an enlarged cross-sectional view of the state in which printed images are obtained in the combination of FIG. 6.

FIG. 8 illustrates the state in which the copying is carried out by using a multiple heat-sensitive copying medium as shown in FIG. 6 comprising the double-sided heat-sensitive member 1, the intermediate member 4 and the transferred image-receiving member 3. The heat element 6 for effecting the recording is applied to the heat-sensitive color forming layer 12 of the double-sided heat sensitive member 1 to produce a colored image 12*a* The corresponding portion of the underlying heat-sensitive transferring layer 13 containing a heat-sensitive color forming material and the corresponding portion of the heat-sensitive transferring layer 43 of the intermediate member 4 are each color-developed and transferred to the transferred image-receiving agent layer 42 of the intermediate member 4 and the transferred image-receiving agent layer 32 of the transferred image-receiving member 3, respectively to produce transferred images 13*b* and 43*a*.

The double-sided heat-sensitive member 1, the member 3 in the FIG. 7, and these two members as well as the intermediate member 4 in the FIG. 8 are placed separately at a certain distance to facilitate the understanding of these drawings. In practice, it is usual that these members are placed so as to bring them into contact with each other and one another.

In FIGS. 2 and 4, only one intermediate member 2 is shown. However, it should be understood that if desired, two or more the intermediate members can be used. In FIGS. 6 and 8 also, only one intermediate member 4 is shown. However, it should be noted that, if desired, two or more of the intermediate members can be laminated and used. In addition, for example, the intermediate member 4 shown in FIG. 6 may be added to the arrangement of each member shown in FIG. 2, and the intermediate member 2 shown in FIG. 2 may be added to the arrangement in FIG. 6.

It is required in this invention that heat generated from the heat element is effectively transmitted without loss to heat-sensitive transferring layers, for example, as denoted by reference numerals 13, 23 and 43 in the attached drawings. To meet with this requirement, good thermally conductive materials are used as the substrate of each member of the multiple heat-sensitive copying media according to this invention, for example, as the substrates 11, 21 and 41 in the attached drawings. This requirement is significantly important in case of the arrangement of each member as shown in FIGS. 2 and 6.

By "good thermally conductive substrate" in this invention is meant a substrate having a good thermal conductivity and/or a small heat capacity. In the good thermally conductive substrate, for example, are included thin materials having a small specific heat and a structure free from gaps containing air as far as possible.

As representatives of the good thermally conductive substrate utilized in this invention, there may be mentioned papers such as glassine paper, parchment paper and the like, plastic films such as cellophane, acetyl cellulose, Saran (trade mark, polyvinylidene chloride), polycarbonates, polyesters and the like. A substrate of less than about 50 microns in thickness may be advantageously utilized, but to make a large number of copies and copies of good quality, it is more preferred to use a substrate of about 10 – 30 microns in thickness.

A heat-sensitive color forming layer employed in this invention which is provided on one side of the good thermally conductive substrate contains an color forming agent capable of forming a color when heated. As this kind of heat-sensitive color forming layer, that comprising a conventional color forming agent capable of forming a color when heated and a binder of a high melting point may be used. If desired, to the component of the heat-sensitive color forming layer may be added at least one member selected from an agent for improving the opacity of the paper and increasing the contrast of a colored image to be obtained such as white pigment, a stabilizer for the color forming agent and an ultraviolet absorber.

As the color forming agents contained in the heat-sensitive color forming layer, those capable of forming a color at a temperature between about 60° and 150°C are preferred.

To form the above-mentioned heat-sensitive color forming layer on the good thermally conductive substrate, a conventional technique of forming a thin film can be utilized. For example, a color forming agent capable of forming a color when heated, a binder and other additives as mentioned above are mixed with water or an organic solvent to prepare a coating agent. The resulting coating agent is coated on the substrate and the solvent is dried to form the heat-sensitive color forming layer.

As representative examples of the color forming agents capable of forming a color when heated which is used in this invention, there may be mentioned:

1. a combination of an iron salt of a fatty acid having a long chain, such as ferric stearate, ferric behenate and the like and a phenol such as gallic acid, methyl gallate, lauryl gallate, protocatechuic acid, ethyl protocatechuate, 3,4-dihydroxybenzophenone and the like;

2. a combination of a metal salt of a fatty acid having a long chain such as cupric behenate and the like and a metal chelating agent such as diphenylcarbazide and the like;

3. a combination of a phenol and a certain kind of photochromic benzoindolinospiropyran compounds; and 4. the combinations of a leuco dye such as Crystal Violet lactone and the like and phenols.

As binders employed in the heat-sensitive color forming layer, those having a melting point of not less than 180°C are preferred. Among these are included acetyl cellulose, methyl cellulose, hydroxyethyl cellulose, hydroxypropyl cellulose, polyvinyl alcohol and the like. In this connection, when a binder of a very low melting point is used, the binder adheres to and dirties the heat element to deteriorate the thermal conductivity of the heat element so that a uniform image can not be obtained since the heat-sensitive color forming layer containing the binder is directly in contact with the heat element.

As agents improving opacity and increasing contrast of colored images added to the heat-sensitive color forming layer, titanium oxide, zinc white, talc, white carbon and the like are preferred.

As solvents for dissolving the binder when the coating of the heat-sensitive color forming layer is applied in the form of a solution, water, alcohols such as methyl alcohol and the like, ketones such as methyl ethyl ketone and the like, esters such as ethyl acetate and the like, hydrocarbons such as toluene and the like, and mixtures thereof are preferred.

The aforementioned color forming agents capable of forming a color when heated which is used in the heat sensitive color forming layer can be used also as heat sensitive color forming materials to be contained in the heat sensitive transferring layers, for example, as denoted by reference numerals 13, 23 and 43 in the attached drawings. A binder used in the heat sensitive transferring layer requires to exhibit properties different from those of the binder used in the aforementioned heat sensitive color forming layer, specifically, it is required that these binders exhibit adhering and transferring properties when heated. As examples of the binder used in the heat sensitive transferring layer, there may be mentioned a rosin having a wax or wax-like material as a principal component thereof to which a mineral oil, an animal oil, a vegetable oil, other oily materials, other resins or a plasticizer is added.

As examples, of the waxes or wax-like materials, there may be mentioned a paraffin wax, microcrystalline wax, ceresin wax, carnauba wax, montan wax, polyethylene glycol, solid fatty acids, solid amides, synthetic waxes, hydrogenated castor wax, hydrogenated spermaceti and the like. The above-mentioned mineral, animal and vegetable oils may be selected from naphthene series mineral oils, paraffin series mineral oils, petrolatum, castor oil, peanut oil, rape seed oil, cotton seed oil, sesame oil, neats foot oil, whale oil and the oxidation polymerized oils thereof.

As examples of the above-mentioned resin used for the binder, there may be mentioned vinyl chloride - vinyl acetate copolymer, polyvinyl butyral resin, vinylidene chloride resin, cellulose resin, acrylic resin, rosin-modified maleic acid resin, chlorinated rubber, casein, gelatine, carboxymethyl cellulose (C.M.C.) and the like.

As plasticizers for the above-mentioned resins, there may be mentioned dioctyl phthalate (D.O.P.), dibutyl phthalate (D.B.P.), tricresyl phosphate (T.C.P.) and the like.

As solvents for the binder, there may be used water, an organic solvent such as alcohols, ketones, esters, petroleum series hydrocarbons and the like, or a mixture thereof.

The transferred image-receiving agent layers provided on the intermediate member and the like, as denoted by reference numerals 42 and 32 in the drawings, have compositions in which the respective principal components are resins and/or waxes exhibiting excellent adhering properties. If desired, fillers such as titanium oxide, zinc white, talc, silica, barite, calcium carbonate, clay and the like may be simultaneously added to the above-mentioned compositions to increase the acceptability for a writing ink, a stamp ink and a printing ink.

Thee resins used for the transferred image-receiving agent layer may be selected from vinyl latex, rubber latex, rosin-modified maleic acid resin, tragacant gum, polybutene, vinyl acetate, vinyl acetate-acrylic ester copolymer and the like.

As the representative waxes used for the transferred image-receiving agent layer, there may be mentioned paraffin waxes, microcrystalline wax, ceresin wax, carnauba wax, montan wax, polyethylene glycol, solid fatty acids, solid amides, synthetic waxes, hydrogenated castor wax, hydrogenated spermaceti and the like.

In connection with the above, it is required that the resins and waxes exhibit a thermally adhering force to the heat-sensitive transferring layer, and these materials must be able to retain firmly the adherence state to the substrate, for example, as denoted by reference numerals 31 and 41 in the drawings.

The following examples are given as illustrative of this invention, but it will be understood that the invention is not limited thereto. In the examples, parts are by weight unless otherwise specified.

Example 1

A double-sided heat-sensitive member as denoted by reference numeral 1 in FIG. 1 was prepared in the following manner.

| (a) Preparation of a heat-sensitive color forming layer | |
|---|---|
| 1. Formulation of suspension A | |
| Ferric behenate | 5 parts |
| Ethylenediamine-tetraacetic acid | 1 |
| Titanium white | 6 |
| Hydroxypropyl cellulose | 8 |
| Methyl alcohol | 60 |
| Acetone | 20 |
| 2. Formulation of suspension B | |
| Lauryl gallate | 5 parts |
| Disodium ethylenediamine-tetraacetic acid | 1 |
| Hydroxypropyl cellulose | 8 |
| Methyl alcohol | 60 |
| Acetone | 20 |

The suspensions A and B were separately ball-milled for 12 hours and mixed. The resulting mixture was coated on a glassine paper of 30 microns in thickness with a coating apparatus equipped with a drier to produce a coating of 5 microns in thickness after dried.

| (b) Preparation of a heat-sensitive transferring layer | |
|---|---|
| 1. Formulation of suspension A | |
| Ferric stearate | 5 parts |
| Microcrystalline wax (160°F) | 11 |
| Ethylenediamine-tetraacetic acid | 1 |
| Polyvinyl butyral | 2 |
| Surface active agent (wax-dispersing agent) | 1 |
| Methyl alcohol | 80 |
| 2. Formulation of suspension B | |
| Lauryl gallate | 5 parts |
| Ethylenediamine-tetraacetic acid | 1 |
| Microcrystalline wax (160°F) | 11 |
| Polyvinyl butyral | 2 |
| Surface active agent (wax-dispersing agent) | 1 |
| Methyl alcohol | 80 |

The suspensions A and B were separately ball-milled for 8 hours and mixed. The resulting mixture was coated on the opposite side to the heat-sensitive color forming layer to form a heat-sensitive transferring layer of 5 microns in thickness.

The double-sided heat-sensitive member thus prepared was combined with a form paper of 50 microns in thickness used as the transferred image-receiving member as an arrangement in FIG. 1 to set them in a thermal printer SILENT 700 (supplied by Texas Instruments Co. Inc., U.S.A.) and the printing was carried out to obtain a black record image on each member.

EXAMPLE 2

A double-sided heat-sensitive member was prepared in a similar manner to that in Example 1 except a MYLAR (polyethylene-terephthalate) film of 0.5 mills (supplied by E. I. du Pont de Nemours & Co. Inc., U.S.A.) was used in place of the substrate, the form paper, used in Example 1. The printing was carried out in a similar manner to that in Example 1 to obtain more distinct record images than those in Example 1.

Example 3

An intermediate member was prepared by using as the substrate the same MYLAR film as that used for the double-sided heat-sensitive member in Example 2 and providing on the one side of the substrate the same heat-sensitive transferring layer as that of the double-sided heat-sensitive member in Example 1. As shown in FIG. 2, the intermediate member thus prepared was placed between the double-sided heat-sensitive member and the transferred image-receiving member used in Example 2, and the printing was carried out in a manner as described in Example 1 to obtain record images.

EXAMPLE 4

The transferred image-receiving agent layer shown below was provided on the opposite side to the heat-sensitive transferring layer of the intermediate member and the transferred image-receiving member used in Example 3.

Formulation of the transferred image-receiving agent layer:

| | |
|---|---|
| Polyvinyl-acrylic ester copolymer emulsion(resin content: 50%) | 20 parts |
| Titanium white | 10 |
| Water | 70 |

The above-mentioned formulation was ball-milled for three hours to prepare a coating composition for the transferred image-receiving agent layer. The resulting coating composition was applied on the opposite side to the heat-sensitive transferring layer of the intermediate member and the transferred image-receiving member in Example 3 with a coating apparatus equipped with a drier to produce a coating of 3 – 5 microns in thickness after dried.

The intermediate member and transferred image-receiving member thus prepared were combined with the double-sided heat-sensitive member used in Example 3 as shown in FIG. 6 and the printing was carried out to obtain more distinct images than in Example 3.

EXAMPLE 5

A double-sided heat-sensitive member was prepared in a similar manner to that in Example 1. A transferred image-receiving member was prepared by providing a transferred image-receiving agent layer similar to that in Example 4 on one side of the form paper used in Example 1. As shown in FIG. 5, these members thus prepared as combined with each other, and the printing was carried out to obtain record images.

EXAMPLE 6

Preparation of a heat-sensitive color forming layer:

| | |
|---|---|
| 1. Formulation of suspension A | |
| Ferric behenate | 5 parts |
| Ethylenediaminetetra-acetic acid | 1 |
| White carbon | 4 |
| Acetyl cellulose | 10 |
| Methyl alcohol | 10 |
| Isopropyl alcohol | 10 |
| Acetone | 60 |
| 2. Formulation of suspension B | |
| 3,4-Dihydroxybenzophenone | 5 parts |
| White carbon | 5 |
| Acetyl cellulose | 10 |
| Methyl alcohol | 10 |
| Isopropyl alcohol | 10 |
| Acetone | 60 |

The coating agent of the heat-sensitive color forming layer was prepared and coated in a similar manner to that in Example 1.

EXAMPLE 7

Preparation of a heat-sensitive color forming layer:

| | |
|---|---|
| 1. Formulation of suspension A | |
| Crystal Violet lactone | 2 parts |
| White carbon | 3 |
| Hydroxyethyl cellulose | 4 |
| Water | 91 |
| 2. Formulation of suspension B | |
| Lauryl gallate | 12 parts |
| White carbon | 3 |
| Hydroxyethyl cellulose | 4 |
| Water | 91 |

The coating agent of the heat-sensitive color forming layer was prepared and coated in a similar manner to that in Example 1.

EXAMPLE 8

Preparation of a heat-sensitive transferring layer:

| | |
|---|---|
| 1. Formulation of suspension A | |
| Ferric laurate | 5 parts |
| Polyethylene glycol (molecular weight: 4000) | 10 |
| Methyl alcohol | 45 |
| Isopropyl alcohol | 40 |
| 2. Formulation of suspension B | |
| Gallic acid | 5 parts |
| Polyethylene glycol (molecular weight: 4000) | 10 |
| Methyl alcohol | 45 |
| Isopropyl alcohol | 40 |

The coating agent was prepared and coated in a similar manner to that in Example 1.

EXAMPLE 9

Preparation of a heat-sensitive transferring layer:

| | |
|---|---|
| 1. Formulation of suspension A | |
| Ferric stearate | 5 parts |
| Ethylenediaminetetra-acetic acid | 1 |
| White carbon | 3 |
| Ethyl cellulose | 7 |
| Paraplex RG-2 (polyester resin, plasticizer, supplied by Rohm & Haas Co.) | 4 |
| Methyl alcohol | 45 |
| Isopropyl alcohol | 40 |
| 2. Formulation of suspension B | |
| Ethyl protocatechuate | 5 parts |
| White carbon | 3 |
| Ethyl cellulose | 7 |
| Paraplex RG-2 (polyester resin, plasticizer, supplied by Rohm & Haas Co.) | 4 |
| Methyl alcohol | 43 |
| Isopropyl alcohol | 38 |

The coating agent of the heat-sensitive transferring layer was prepared and coated in a similar manner to that in Example 1. Since the transferring layer obtained from the above-mentioned formulation gave a feeling of dryness and exhibited a poor thermally transferring property, the double-sided heat-sensitive member having the above-mentioned transferring layer was combined with the intermediate member and the transferred image-receiving member each having the transferred image-receiving agent layer prepared in Example 4 and the printing was carried out to obtain distinct copies.

EXAMPLE 10

Preparation of a heat-sensitive transferring layer:

| | | |
|---|---|---|
| 1. | Formulation of suspension A | |
| | Crystal Violet lactone | 2 parts |
| | Titanium white | 3 |
| | Microcrystalline wax emulsion (wax content: 50%) | 20 |
| | Water | 75 |
| 2. | Formulation of suspension B | |
| | Bisphenol A | 12 parts |
| | Titanium white | 3 |
| | Microcrystalline wax emulsion (wax content: 50%) | 20 |
| | Water | 65 |

The coating agent was prepared and coated in a similar manner to that in Example 1.

EXAMPLE 11

Formulation of a transferred image-receiving agent layer:

| | |
|---|---|
| Microcrystalline wax (160°F) | 7 parts |
| Paraffin wax (140°F) | 2 |
| Talc | 3 |
| Toluene | 88 |

The coating agent of the transferred image-receiving agent layer was prepared and coated in a similar manner to that in Example 4.

EXAMPLE 12

Formulation of the heat-sensitive transferred image-receiving agent layer:

| | |
|---|---|
| Paraffin wax (140°F) | 4 parts |
| Polybutene | 4 |
| Calcium carbonate | 4 |
| Toluene | 88 |

The coating agent was prepared and coated in a similar manner to that in Example 4.

It is preferred in the practical operation that each of a coating and a substrate is selected so that an excellent copy may be obtained, depending upon the qualities of the obtained image such as a color, density, distinctness and the like, the number of the recording paper, a temperature of the heat element, heating time by the heat element, a contact degree of the heat element with the paper and other requirements. It will be understood, however, that those skilled in the art can readily select each of a coating and a substrate to meet with the above-mentioned requirements on the basis of the embodiments of this invention.

We claim:

1. A multiple heat-sensitive copying medium for thermal printers comprising a double-sided heat-sensitive member comprising a substrate having on one side thereof a heat sensitive color forming layer selected from the group consisting of a combination of an iron salt of a fatty acid having a long chain and a phenol, a combination of a metal salt of a fatty acid having a long chain and a metal chelating agent, a combination of phenol and a photochromic benzoindolinospiropyran compound, a combination of a leuco dye and a phenol; and on the other side thereof a heat-sensitive transferring layer, said member being of a good thermal conductivity and said heat-sensitive transferring layer containing a heat-sensitive color forming material and a binder of resinous material comprising a wax or wax-like material and an oil.

2. A multiple heat-sensitive copying medium comprising a double-sided heat-sensitive member comprising a substrate of good thermal conductivity having on one side thereof a heat-sensitive color forming layer selected from the group consisting of a combination of an iron salt of a fatty acid having a long chain and a phenol, a combination of a metal salt of a fatty acid having a long chain and a metal chelating agent, a combination of a phenol and a photochromic benzoindolinospiropyran compound, a combination of a leuco dye and a phenol; and on the other side thereof a heat-sensitive transferring layer containing a heat-sensitive color forming material and a binder of resinous material comprising a wax or wax-like material and an oil, and at least one intermediate member having a good thermally conductive substrate and a heat-sensitive transferring layer containing a heat-sensitive color forming material, said intermediate member being disposed so that the opposite side to the heat-sensitive transferring layer thereof and the heat-sensitive transferring layer of said double-sided heat sensitive member may be maintained in face to face relationship.

3. A multiple heat-sensitive copying medium comprising a double-sided heat-sensitive member comprising a substrate of good thermal conductivity having on one side thereof a heat-sensitive color forming layer selected from the group consisting of a combination of an iron salt of a fatty acid having a long chain and a phenol, a combination of a metal salt of a fatty acid having a long chain and a metal chelating agent, a combination of a phenol and a photochromic benzoindolinospiropyran compound, a combination of a leuco dye and a phenol; and on the other side thereof a heat-sensitive transferring layer containing a heat-sensitive color forming material and a binder of resinous material comprising a wax or wax-like material and an oil, and a transferred image-receiving member comprising a substrate having on one side a transferred image-receiving agent layer, said transferred image-receiving member being disposed so that the transferred image-receiving agent layer thereof and the heat-sensitive transferring layer of said double-sided heat-sensitive member are maintained in face to face relationship.

4. A multiple heat-sensitive copying medium comprising a double-sided heat-sensitive member comprising a substrate of good thermal conductivity having on one side thereof a heat-sensitive color forming layer selected from the group consisting of a combination of an iron salt of a fatty acid having a long chain and a phenol, a combination of a metal salt of a fatty acid having a long chain and a metal chelating agent, a combination of a phenol and a photochromic benzoindolinospiropyran compound, a combination of a leuco dye and a phenol; and on the other side thereof a heat-sensitive transferring layer containing a heat-sensitive color forming material and a binder of resinous material comprising a wax or wax-like material and an oil, at least one intermediate member comprising a substrate of good thermal conductivity having on one side thereof a transferred image-receiving agent layer and on the other side thereof a heat-sensitive transferring layer containing a heat-sensitive color forming material and a transferred image-receiving member comprising a substrate having on one side a transferred image-receiving agent layer, said intermediate member being disposed between said double-sided heat-sensitive member and said transferred image-receiving member so that said transferred image-receiving agent layer of said intermediate member and said heat-sensitive transferring layer of said double-sided heat-sensitive member, and said heat-sensitive transferring layer of said intermediate member and said transferred image-receiving agent layer of said transferred image-receiving member are maintained in face to face relationship, respectively.

5. A multiple heat-sensitive copying medium for thermal printers according to claim 1 wherein said iron salt of a fatty acid having a long chain is selected from the group consisting of ferric stearate, ferric behenate, and said phenol is selected from the group consisting of gallic acid, methyl gallate, lauryl gallate, protocatechuic acid, ethyl protocatechuate, and 3,4-dehydroxybenzophenone.

6. A multiple heat-sensitive copying medium for thermal printers according to claim 1 wherein said metal salt of a fatty acid having a long chain is cupric behenate, and said metal chelating agent is diphenylcarbazide.

7. A multiple heat-sensitive copying medium for thermal printers according to claim 1 wherein said wax or wax-like material is selected from the group consisting of a paraffin wax, microcrystalline wax, ceresin wax, carnauba wax, montan wax, polyethylene glycol, solid fatty acids, solid amides, synthetic waxes, hydrogenated castor wax, and hydrogenated spermaceti.

8. A multiple heat-sensitive copying medium for thermal printers according to claim 1 wherein said oil is selected from the group consisting of naphthene series mineral oils, paraffin series mineral oils, petrolatum, castor oil, peanut oil, rape seed oil, neats foot oil, whale oil and the oxidation polymerized oils thereof.

* * * * *

UNITED STATES PATENT AND TRADEMARK OFFICE

CERTIFICATE OF CORRECTION

PATENT NO. : 3,983,279

DATED : September 28, 1976

INVENTOR(S) : HIROMU MATSUSHITA, et al.

It is certified that error appears in the above-identified patent and that said Letters Patent are hereby corrected as shown below:

First page, bibliographic data, below INID Code "[21]", insert:

-- [30] Foreign Application Priority Data

July 19, 1973 Japan ..... 48/80509 --

Signed and Sealed this

Twenty-second Day of February 1977

[SEAL]

*Attest:*

RUTH C. MASON
*Attesting Officer*

C. MARSHALL DANN
*Commissioner of Patents and Trademarks*